United States Patent [19]

Zimmer

[11] Patent Number: 4,584,961

[45] Date of Patent: Apr. 29, 1986

[54] GOLF SCORING DEVICE

[76] Inventor: Ronald Zimmer, 115 N. Benton Rd., West Frankfort, Ill. 62896

[21] Appl. No.: 526,360

[22] Filed: Aug. 25, 1983

[51] Int. Cl.[4] ..... A63B 57/00

[52] U.S. Cl. ..... 116/223; 273/162 A; 273/DIG. 26; 235/117 A

[58] Field of Search ..... 116/222, 223, 309, 311, 116/312, 313, 316, 317; 273/87 R, 162 A, DIG. 26; 235/117 A, 1 B, 1 R, 1 D, 117 R, 118; D10/46.1; 206/534, 549; 434/292, 402; 40/334, 493, 514

[56] References Cited

U.S. PATENT DOCUMENTS

| | | | |
|---|---|---|---|
| 1,980,844 | 11/1934 | Ball | 116/223 |
| 2,167,465 | 7/1939 | Sell | 40/334 |
| 2,211,635 | 8/1940 | Barteaux | 116/223 |
| 3,040,982 | 6/1962 | Sanders | 235/117 A |
| 3,468,479 | 9/1969 | Sauter | 235/117 R |
| 3,770,193 | 11/1973 | Sauter | D10/46.1 |

*Primary Examiner*—Charles Frankfort
*Assistant Examiner*—Patrick R. Scanlon

[57] ABSTRACT

A scoring device for golf comprising a cylindrical rod or tube having a plurality of numeral sets printed circumfluently along its surface about which a plurality of partially open snap rings are rotatably affixed for the purpose of recording one's score while playing golf.

3 Claims, 1 Drawing Figure

GOLF SCORING DEVICE

This invention relates to a scoring device primarily designed to be used by people who play golf.

As a general rule most golfers probably keep a record of their score on a score card with pen or pencil. Many times these are forgotten, and at other times this simple task becomes burdensome. Some or many golfers just do not like to worry with writing down scores. It is for these reasons that leads to the principal objective of this invention: that objective being to provide an easy way to keep an individual golf score without the scorecard and the pencil.

Another objective is to provide a scoring device which can be used over and over again.

A final objective to this invention is to provide a practical and functional device at a minimum of expense to the consumer.

I accomplish these objectives by such design and arrangement of parts as will become evident upon the close scrutiny of the following specification and claims.

DETAILED DESCRIPTION OF THE INVENTION

Figure 1:
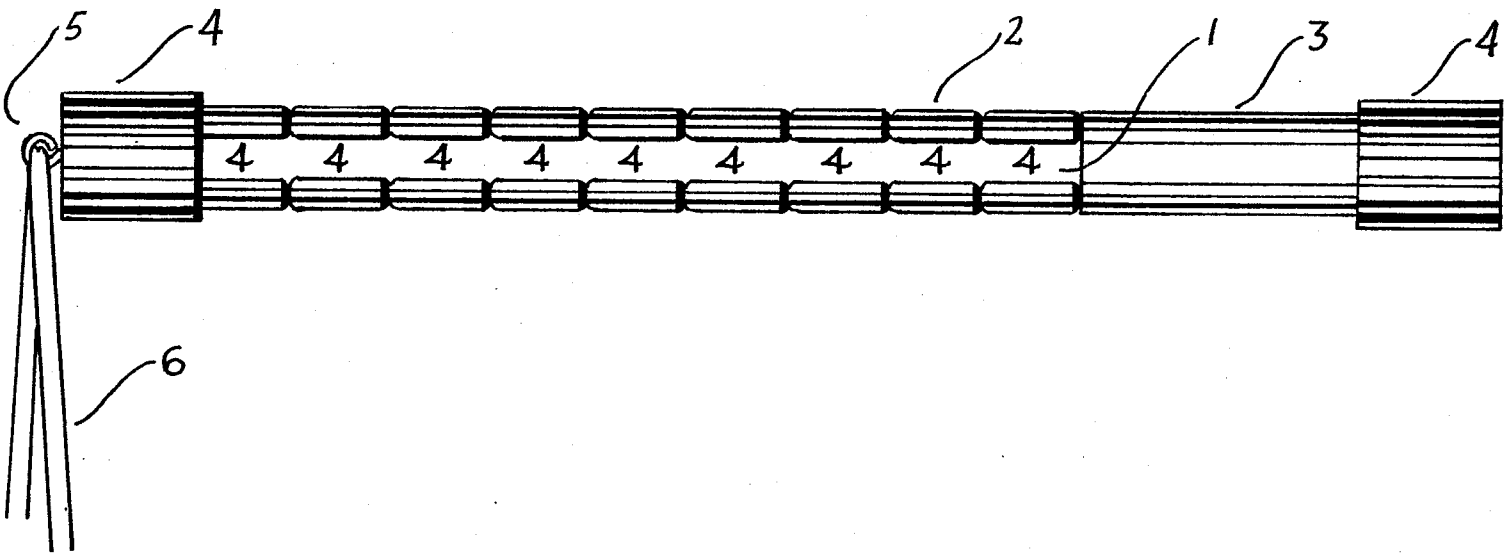
FIG. 1 is an elevation view of a golf scoring device constructed in accordance with the principles of the invention showing the device ready to be used.

The invention consists of a cylindrical rod or tube which may be composed of wood, metal, or plastic. The rod or tube is printed circumfluently with numeral sets two thru nine along its length beginning an inch or so from its left end. Partially open plastic or metal snap rings about the width of a dime and with an inside diameter just smaller than the outside diameter of the rod or tube are then snapped about the rod or tube to partially cover each set of numerals. The numeral sets have been printed in such spacial arrangement along the rod or tube to allow the snap rings to fit adjacently on the rod or tube. The inner diameter of the snap rings must be just a little smaller than the outside diameter of the rod or tube to allow the snap rings to stay in a fixed position once they are rotated about the rod or tube. They must fit tight enough to stay in place and yet free enough to rotate about the rod or tube.

The purpose of the snap rings rotating about the rod or tube is to expose the printed numeral representing the correct charge of strokes for each hole of golf played. Because of limited space about the rod or tube, and their rarity for use, the numerals one and zero have been omitted.

Pipe like tubing about the same size as the snap rings has been slipped over the rod or tube to the right and left of the snap ring area. One side is a little longer than the other, and serves as a handle for the device.

It should be understood that this step of adding pipe like tubing to the basic rod or tube could be eliminated if the basic rod or tube was produced by plastic molding or by a lathing process.

A plastic cap is placed over each end of the device to give it a finished look.

At the end of the device opposite the handle, a screw eye has been inserted, and to this eye is attached a cord or rawhide strip for means of attaching the scoring device to ones golf bag. A small hole drilled through the rod or tube near the end opposite the handle could be used in place of the screw eye.

In reference now to the characters on the drawing, the device comprises a basic cylindrical rod or tube 1 about which nine partially open snap rings 2 are affixed. The cylindrical area to the right of the snap rings serves as a handle 3 for the device. Each end of the device is covered by a plastic cap 4 and at the end of the device opposite the handle, a screw eye 5 is inserted. A cord 6 of some nature is then attached to the screw eye for the purpose of attaching the device to one's golf bag.

In using this device a person needs only to select a starting point, right or left, and then as each hole of golf is played, rotate the appropriate snap ring until the numeral representing the number of strokes charged for that hole of play becomes exposed. This can easily and quickly be done by grasping the device in one hand and rotating the snap ring with the other.

If one should want to record the score on a score card he always has that option. Hopefully this scoring device will become a handy and valuable piece of equipment for all those who enjoy the wonderful game of golf.

Changes in shape, size, materials and rearrangement of parts may be resoiled to in actual practice without departing from the spirit of the invention or scope of the claims as is understood.

What I claim as new and useful and desire to secure by Letters Patent is:

1. A gold scoring device comprising an elongated cylindrical body member having a first section and a second section said first section being of lesser diameter than said second section whereby a shoulder is formed between said sections, a plurality of numeral sets each being printed circumferentially around the outer surface of said first section, said numeral sets being longitudinally spaced along said first section so that like numerals of each set are aligned.

a plurality of snap rings arranged side-by-side on said first section, each of said snap rings being of part circular cross section with circumferentially spaced ends defining an opening therebetween, the snap rings resiliently embracing said first section of said body member for frictional rotation thereon, each snap ring covering one of the numeral sets except for a single numeral of the set which is exposed in the respective snap ring opening, whereby rotation of each ring is effective to expose a selected numeral of a respective set of said numeral sets to indicate a golfer's score for a selected hole, an end cap provided on an end of said first section opposite said shoulder whereby said plurality of snap rings are held in abutting relationship on said first section between said shoulder and said end cap.

2. The golf scoring device of claim 13 further comprising another end cap provided on an end of said second section opposite said shoulder.

3. The golf scoring device of claim 14 further comprising a cord connected to one of the end caps for attaching the scoring device to other equipment.

* * * * *

UNITED STATES PATENT AND TRADEMARK OFFICE

CERTIFICATE OF CORRECTION

PATENT NO. : 4,584,961

DATED : April 29, 1986

INVENTOR(S) : Ronald Zimmer

It is certified that error appears in the above-identified patent and that said Letters Patent is hereby corrected as shown below:

Column 2, line 26, "resoiled" should read -- resorted --.

Column 2, line 31, "gold" should read -- golf --.

Signed and Sealed this

*Twenty-second* Day of *July 1986*

[SEAL]

*Attest:*

DONALD J. QUIGG

*Attesting Officer*

*Commissioner of Patents and Trademarks*